US012241257B2

(12) United States Patent
Shin

(10) Patent No.: US 12,241,257 B2
(45) Date of Patent: Mar. 4, 2025

(54) MODULAR BUILDING INTERIOR AND EXTERIOR MATERIAL UNIT

(71) Applicant: Chang Yoon Shin, Gwangju (KR)

(72) Inventor: Chang Yoon Shin, Gwangju (KR)

( * ) Notice: Subject to any disclaimer, the term of this patent is extended or adjusted under 35 U.S.C. 154(b) by 15 days.

(21) Appl. No.: 18/679,741

(22) Filed: May 31, 2024

(65) Prior Publication Data

US 2024/0410183 A1 Dec. 12, 2024

(30) Foreign Application Priority Data

Jun. 7, 2023 (KR) ..... 10-2023-0072737

(51) Int. Cl.
*E04F 13/08* (2006.01)
*E04B 2/90* (2006.01)

(52) U.S. Cl.
CPC ..... *E04F 13/0898* (2013.01); *E04F 13/0841* (2013.01); *E04F 13/0866* (2013.01); *E04B 2/90* (2013.01); *E04F 2201/0523* (2013.01)

(58) Field of Classification Search
CPC . E04F 13/0805; E04F 13/0821; E04F 13/081; E04F 13/0803; E04F 13/0898;
(Continued)

(56) References Cited

U.S. PATENT DOCUMENTS 2,012,070 A * 8/1935 Hohl ..... E04F 13/0803 52/762
2,067,252 A * 1/1937 Whelan ..... E04F 13/0805 52/483.1

(Continued)

FOREIGN PATENT DOCUMENTS

EP 2397643 B1 * 3/2018 ..... E06B 7/14
KR 101016820 B1 * 9/2009 ..... E04F 13/0803
KR 10-2011-0120265 11/2011
KR 10-2012-0074124 7/2012
KR 10-2411340 6/2022
KR 10-2474850 12/2022

*Primary Examiner* — Omar F Hijaz
(74) *Attorney, Agent, or Firm* — LEX IP MEISTER, PLLC

(57) ABSTRACT

Provided is a modular building interior and exterior material unit which is combined to neighboring modular building interior and exterior material units to be used as an interior and exterior material in a building. The modular building interior and exterior material unit includes a pair of vertical frames which are symmetric, spaced apart from each other, and include seating frames at the side thereof which are protruded in a longitudinal direction, wherein the seating frames comprise seating grooves formed therein, at least one panel attached to the outside of the pair of vertical frames, at least one clip including one end combined to the side of the vertical frame and the other end inserted into a through hole formed on the vertical frame of the other neighboring modular building interior and exterior material unit, and gaskets which are protruded in a longitudinal direction along each side of the pair of vertical frames, combined to the seating grooves, and are formed of an elastic material. When the neighboring modular building interior and exterior material units are connected to each other by using the clip, the gaskets combined to each modular building interior and exterior material unit may tightly contact each other and seal the space between the neighboring modular building interior and exterior material units.

8 Claims, 8 Drawing Sheets

(58) Field of Classification Search
CPC ..... E04F 13/0841; E04F 13/0866; E04F 2201/0523; E04F 13/0889; E04F 13/0826; E06B 3/263; E06B 3/46; E04B 2/90
See application file for complete search history.

(56) References Cited

U.S. PATENT DOCUMENTS 5,083,405 A * 1/1992 Miller ..... E04B 1/7612 52/235
5,170,602 A * 12/1992 Ribic ..... E06B 3/6621 52/476
5,239,798 A * 8/1993 Saito ..... E04C 2/384 52/235
5,444,945 A * 8/1995 Goodwin ..... E04F 19/06 52/220.1
6,425,218 B1 * 7/2002 Doyon ..... E04F 13/081 52/552

* cited by examiner

MODULAR BUILDING INTERIOR AND EXTERIOR MATERIAL UNIT

CROSS-REFERENCE TO RELATED PATENT APPLICATION

This application claims the benefit of Korean Patent Application No. 10-2023-0072737, filed on Jun. 7, 2023, in the Korean Intellectual Property Office, the disclosure of which is incorporated herein in its entirety by reference.

BACKGROUND OF THE INVENTION

1. Field of the Invention

The present invention relates to modular building interior and exterior material units, and more particularly, to modular building interior and exterior material units in which gaskets are tightly combined to each other without performing a sealant work in the work site when the units are attached to exterior or interior walls in a building so that water tightness, air tightness, and heat insulation property may be improved.

2. Description of the Related Art

In general, a wet method and a dry wall fixing method are applied to a finishing method of attaching exterior materials to an exterior or interior wall in a building such as a building or an office. Here, the wet method uses cement mortar as an adhesive material to attach exterior materials to walls in a building. However, such a method is uneconomical due to the long curing time of the mortar and problems in construction.

Also, the dry wall fixing method is used to attach exterior materials by installing a separate fixing device formed of a structure on the wall of a building. Such a method is widely used due to the short working time and many advantages in usability and constructability.

The Korean Patent Publication No. 10-2411340 discloses a building interior and exterior material unit which may be installed on a wall of a building. Such a prior art has the advantages that the unit may be simply assembled and installed without installation of a steel-frame structure on a wall and seismic performance is available. However, when the building interior and exterior material unit disclosed in the Korean Patent Publication No. 10-2411340 is installed on an exterior or interior wall in a building, a sealant work and a process of increasing water tightness and air tightness are essentially needed. Also, when the interior and exterior material is installed by using the existing method, a space may exist between panels. If such a space is not blocked by using silicon and the panels are installed by installing a steel panel frame on a wall, moisture generated by rain or snow may penetrate into the space due to defective and old sealant which may cause water leak of a building. Also, a steel structure may be twisted or corroded. In addition, if the panels are not air-tightened, structures may be deformed or corroded as time passes. Accordingly, in general, a sealant work such as injecting of silicon or a backup material into spaces between the panels is essentially needed after the interior and exterior material panels are installed. However, if such a sealant work is performed, an installation process may be added and thereby, various problems may occur due to additional cost of materials, high personnel expenses, increased difficulties in construction, and oil contamination and water leak from the part of old sealant, as time passes.

SUMMARY OF THE INVENTION

The present invention provides modular building interior and exterior material units in which gaskets are tightly combined to each other without performing a sealant work in the work site when the units are attached to exterior or interior walls in a building so that water tightness, air tightness, and heat insulation property may be improved.

According to an aspect of the present invention, there is provided a modular building interior and exterior material unit which is combined to neighboring modular building interior and exterior material units to be used as an interior and exterior material in a building, the modular building interior and exterior material unit including: a pair of vertical frames which are symmetric, spaced apart from each other, and include seating frames at the side thereof which are protruded in a longitudinal direction, wherein the seating frames comprise seating grooves formed therein; at least one panel attached to the outside of the pair of vertical frames; at least one clip comprising one end combined to the side of the vertical frame and the other end inserted into a through hole formed on the vertical frame of the other neighboring modular building interior and exterior material unit; and gaskets which are protruded in a longitudinal direction along each side of the pair of vertical frames, combined to the seating grooves, and are formed of an elastic material. When the neighboring modular building interior and exterior material units are connected to each other by using the clip, the gaskets combined to each modular building interior and exterior material unit may tightly contact each other and seal the space between the neighboring modular building interior and exterior material units.

The gaskets may include an elastic part which has the form of a pillar having a hollow therein; a coupling part which is extended from the elastic part, protruded to one side direction of the elastic part, and inserted into the seating grooves to be fixed and combined thereto; and a blocking part which is extended from the front or the back of the elastic part, has the form of a plate, and is protruded to the other side direction of the elastic part.

In the gasket combined to one vertical frame from among the pair of vertical frames, the blocking part may be extended in a direction which may block the outer surface of the space between the neighboring building interior and exterior material units and in the gasket combined to the other vertical frame from among the pair of vertical frames, the blocking part may be extended in a direction which may block the inner surface of the space between the neighboring building interior and exterior material units.

When the neighboring modular building interior and exterior material units are connected to each other, the blocking part may be extended from the elastic part so as to contact the seating frame of the neighboring modular building interior and exterior material unit.

The seating grooves may have openings narrower than the width of the inside space and may be formed on the seating frames, and the coupling part may be inserted into the inside space through the opening of the seating groove by using an elastic force and then, may be fixed by being held by a projection jaw formed around the opening by using a restoring force.

The gasket may be formed of polyurethane or rubber.

The modular building interior and exterior material unit may further include a bracket fixed and installed to the side of the vertical frame, wherein the bracket may be combined and fixed to an anchor bolt that is fixed and installed to a wall of a building.

The modular building interior and exterior material unit may further include an insulator combined between the pair of vertical frames, wherein the insulator may be spaced apart from the surface of the panels.

The modular building interior and exterior material unit may further include at least one bonding plate having the form of a flat plate combined to at least one of the outer side and the inner side of the pair of vertical frames.

The vertical frames may further include frame insulation parts which surround bent portions of the vertical frames and have the form of a pipe, wherein the frame insulation parts may include inlet parts which are opened at one side of the frame insulation parts for insulation filler joints to be injected therethrough; and cutting parts which are cut when the insulation filler joints are filled in the frame insulation parts through the inlet parts and then are hardened.

In the frame insulation parts, the inlet parts and the cutting parts may be formed on the other surface of the frame insulation parts so that the heat and cold is not transmitted through the vertical frames.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
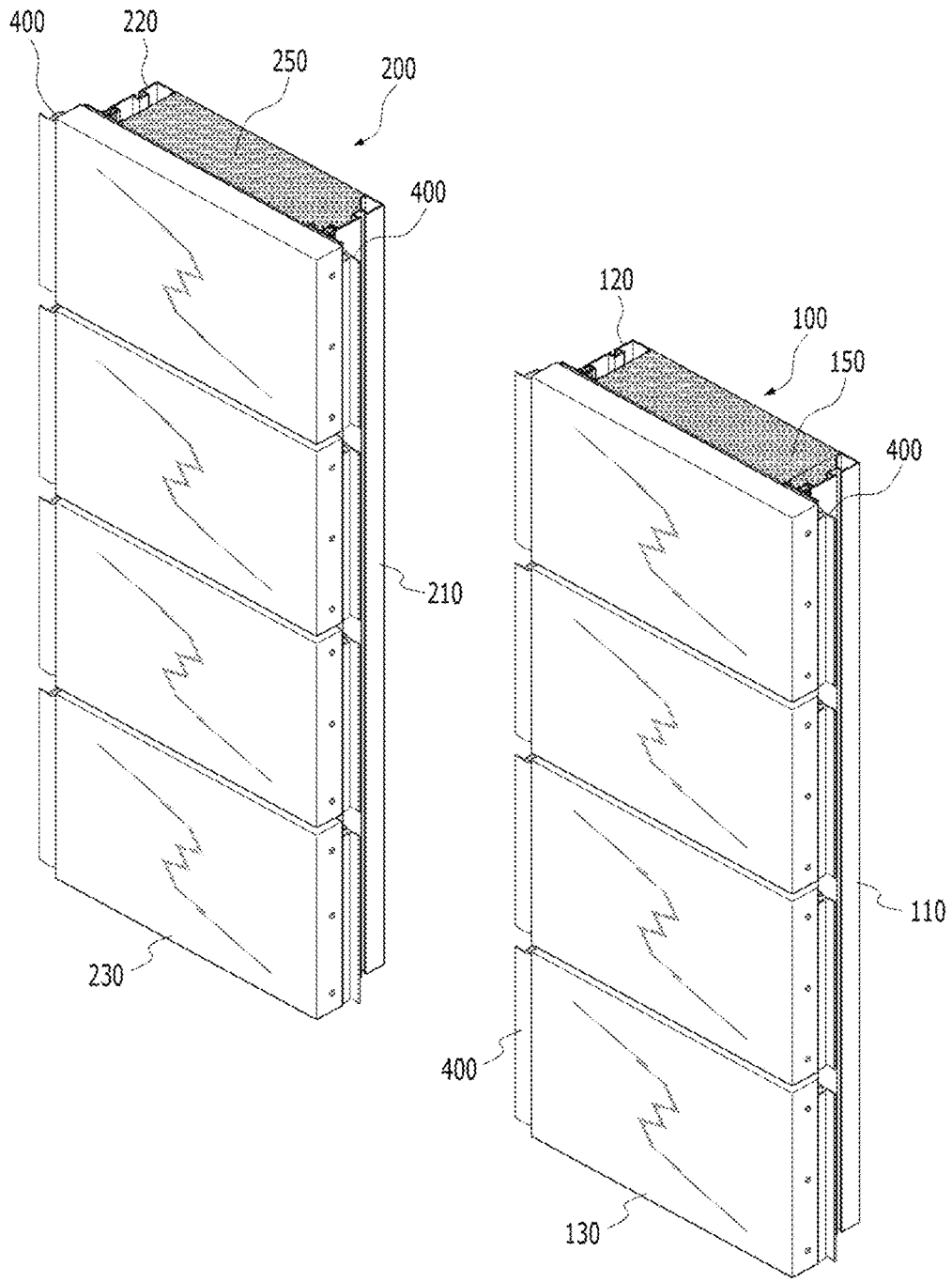
FIG. 1 is a perspective view of modular building interior and exterior material units according to an embodiment of the present invention.

The exemplary embodiments of the present invention will be described in detail with reference to the accompanying drawings and description of the drawings so as to fully understand advantages and objectives of the present invention.

Hereinafter, embodiment of the present invention will be described more fully with reference to the accompanying drawings. In the drawings, like reference numerals denote like elements.

Figure 2:
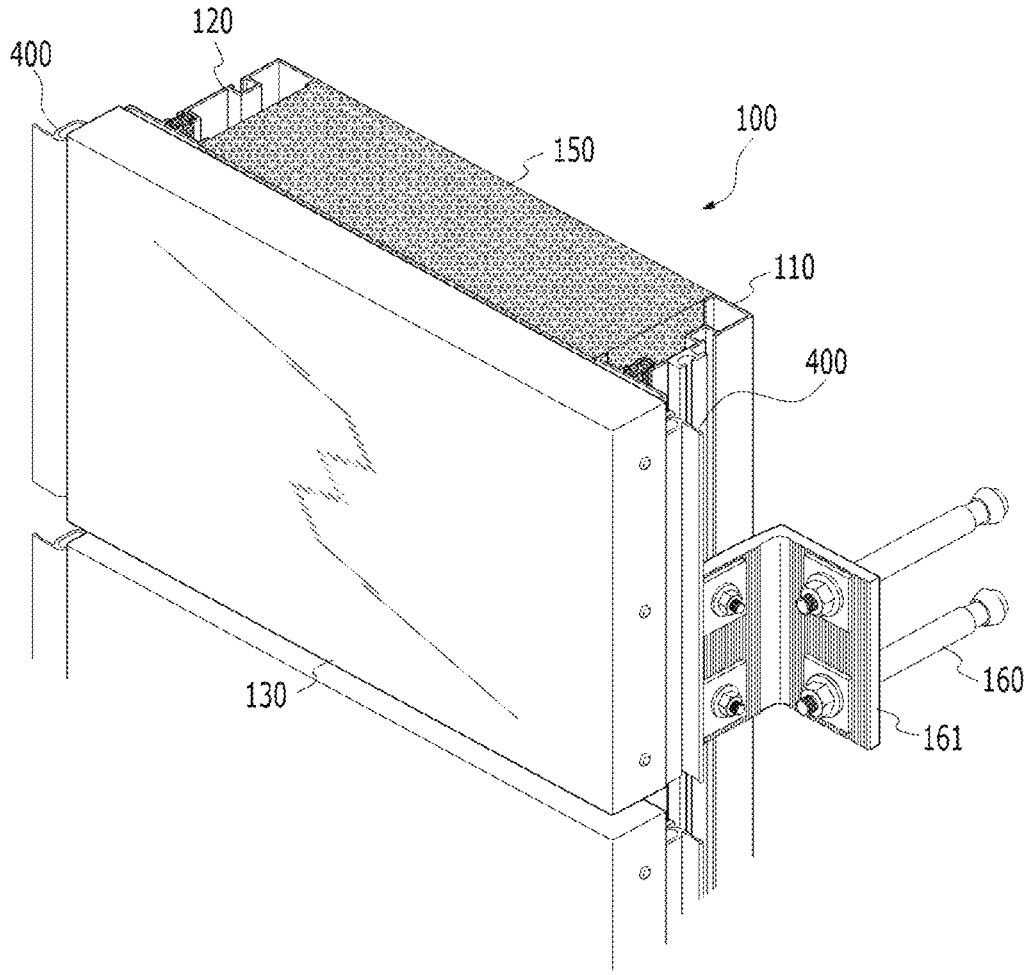
FIG. 2 is a perspective view of the enlarged modular building interior and exterior material unit of FIG. 1.
Figure 3:
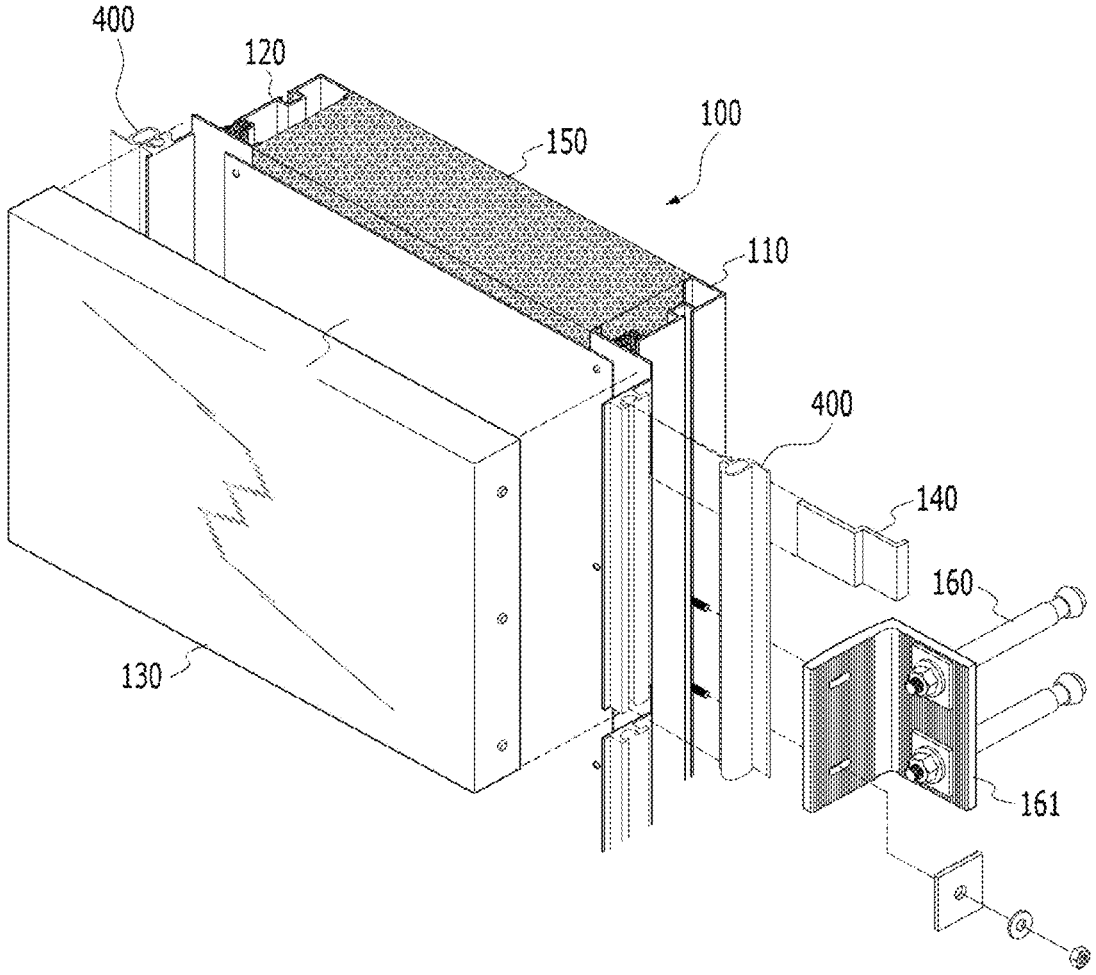
FIG. 3 is an exploded perspective view of the modular building interior and exterior material unit of FIG. 2.
Figure 4:
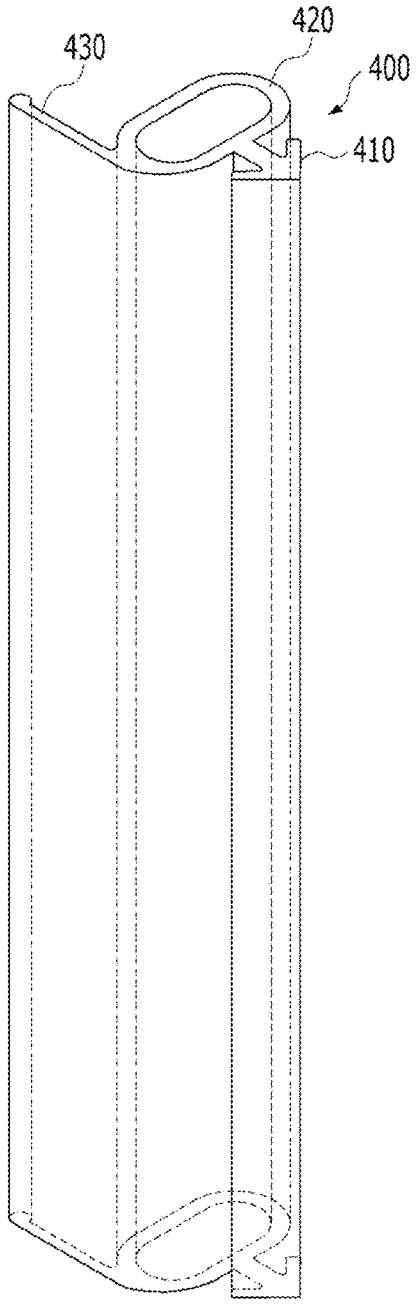
FIG. 4 illustrates an example of a gasket combined to the modular building interior and exterior material units of FIG. 1.
Figure 5:
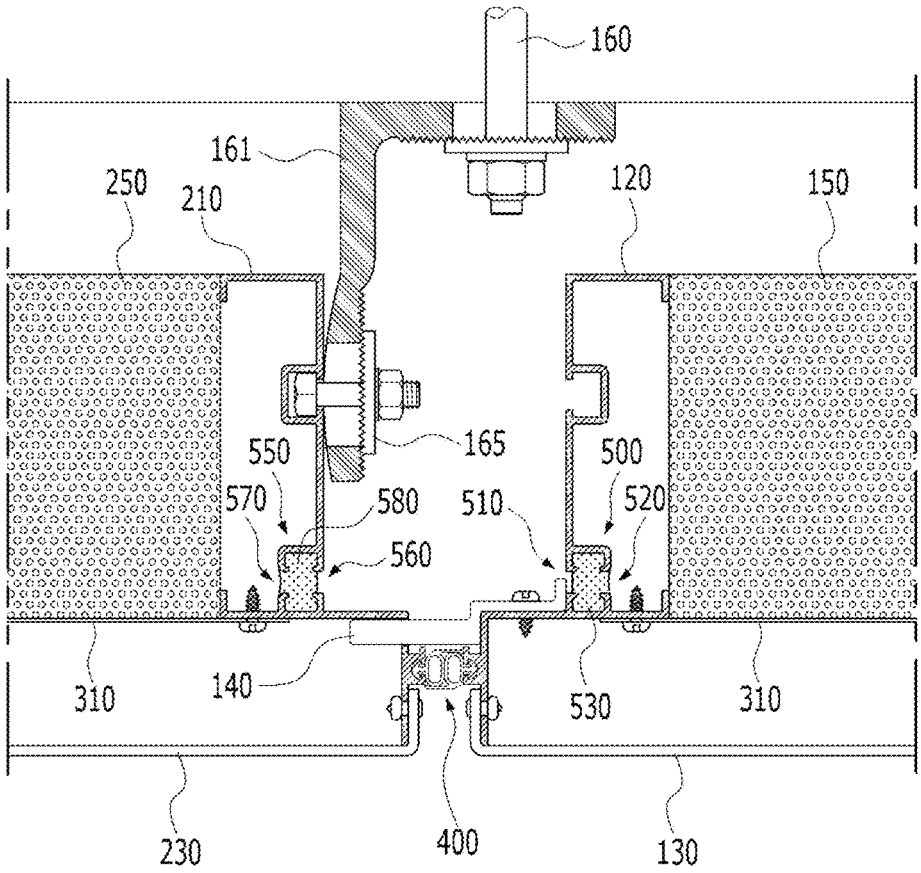
FIG. 5 is a cross-sectional view illustrating an example in which the modular building interior and exterior material units of FIG. 1 are combined to each other.
Figure 6:
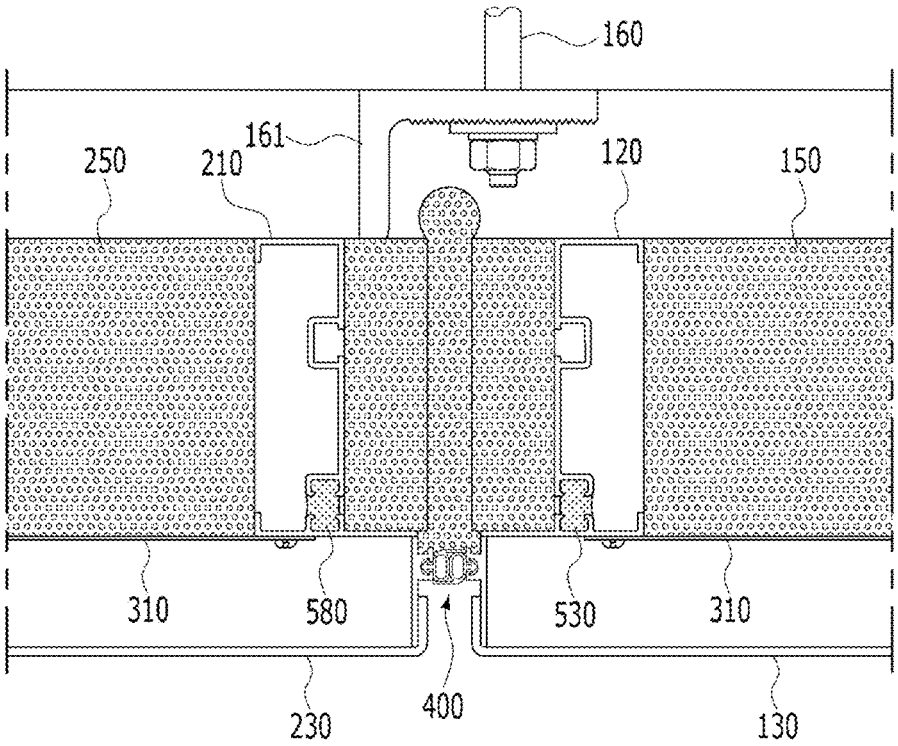
FIG. 6 is a cross-sectional view illustrating another example in which the modular building interior and exterior material units of FIG. 1 are combined to each other.
Figure 7:
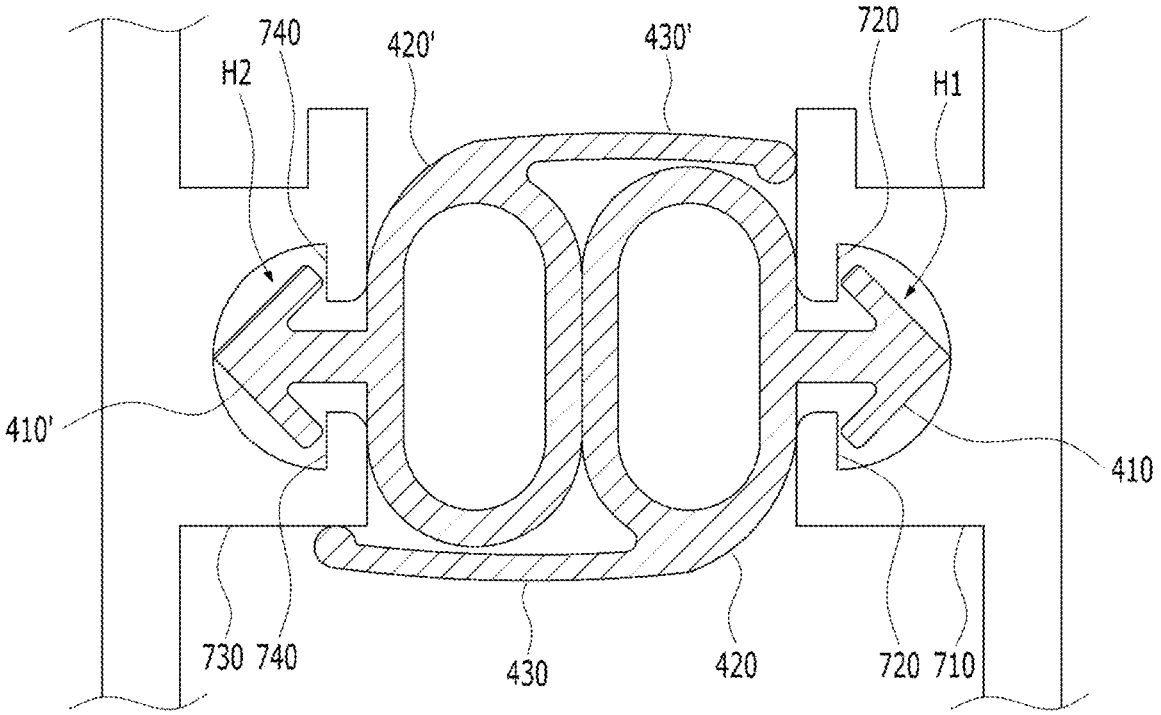
FIG. 7 is a cross-sectional view illustrating the enlarged gasket while the modular building interior and exterior material units of FIG. 1 are combined to each other.
Figure 8:
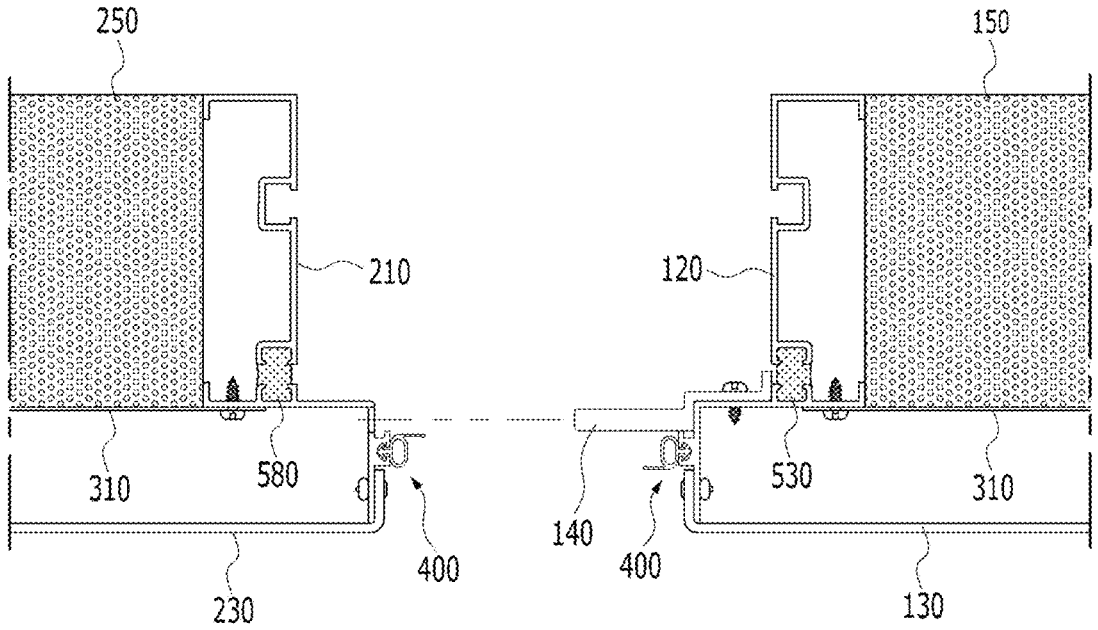
FIG. 8 is a cross-sectional view illustrating the state before the modular building interior and exterior material units of FIG. 1 are combined to each other.

FIG. 1 is a perspective view of modular building interior and exterior material units 100 and 200 according to an embodiment of the present invention, FIG. 2 is a perspective view of the enlarged modular building interior and exterior material unit 100 of FIG. 1, FIG. 3 is an exploded perspective view of the modular building interior and exterior material unit 100 of FIG. 2, FIG. 4 illustrates an example of a gasket 400 combined to the modular building interior and exterior material units 100 and 200 of FIG. 1, FIG. 5 is a cross-sectional view illustrating an example in which the modular building interior and exterior material units 100 and 200 of FIG. 1 are combined to each other, FIG. 6 is a cross-sectional view illustrating another example in which the modular building interior and exterior material units 100 and 200 of FIG. 1 are combined to each other, FIG. 7 is a cross-sectional view illustrating the enlarged gasket 400 while the modular building interior and exterior material units 100 and 200 of FIG. 1 are combined to each other, and FIG. 8 is a cross-sectional view illustrating the state before the modular building interior and exterior material units 100 and 200 of FIG. 1 are combined to each other.

Referring to FIGS. 1 through 8, the modular building interior and exterior material units 100 and 200 according to an embodiment of the present invention may be combined to neighboring modular building interior and exterior material units and may be used as exterior and interior materials in buildings. That is, the modular building interior and exterior material unit 100 may be combined to neighboring modular building interior and exterior material units which are combined to a wall of a building and may be used as exterior and interior materials in buildings. As an example, the modular building interior and exterior material unit 100 may be fixed to a wall of a building in such a way that a bracket 161 is fixed and installed to the side of a vertical frame 110 in the modular building interior and exterior material unit 100 and is combined and fixed to an anchor bolt 160 that is fixed and installed to a wall of a building. However, the modular building interior and exterior material unit 100 may be fixed and installed to a wall of a building by using various methods and the bracket 161 and the anchor bolt 160 may not be always needed for the modular building interior and exterior material unit 100 to be fixed to a wall of a building in the present invention.

The modular building interior and exterior material units 100 and 200 may respectively include a pair of vertical frames 110 and 120, a pair of vertical frames 210 and 220, at least one panel 130 and 230, at least one clip 140, and a plurality of gaskets 400.

The pair of vertical frames 110 and 120 and the pair of vertical frames 210 and 220 may be symmetric, spaced apart from each other, and respectively include seating frames 710 and 730 at the side thereof which are protruded in a longitudinal direction. Also, seating grooves H1 and H2 may be respectively included in the seating frames 710 and 730. In addition, the at least one panel 130 and 230 may be respectively attached to the outside of the pair of vertical frames 110 and 120 and the pair of vertical frames 210 and 220. Furthermore, the at least one clip 140 includes one end combined to the side of the vertical frame and the other end inserted into a through hole formed on the vertical frame of the other neighboring modular building interior and exterior material and thereby, may be used to combine the modular building interior and exterior material units. For example, as illustrated in FIG. 8, the clip 140 is inserted into a through hole formed on the vertical frame 210 of the other modular building interior and exterior material unit 200 while the clip 140 is combined to the side of the vertical frame 120 of the modular building interior and exterior material unit 100 and thereby, the modular building interior and exterior material units 100 and 200 may be combined to each other.

The gaskets 400 may be formed of an elastic material and may be protruded in a longitudinal direction along each side of the pair of vertical frames 110 and 120 and the pair of vertical frames 210 and 220 so as to be combined to the seating grooves H1 and H2. As illustrated in the drawings, the gasket 400 may be combined to the seating groove formed on the side of the vertical frame 110 and the gasket 400 may be combined to the seating groove formed on the side of the vertical frame 120 in the modular building interior and exterior material unit 100. As in the same manner, in the modular building interior and exterior material unit 200, the gasket 400 may be combined to the seating groove formed on the side of the vertical frame 210 and the gasket 400 may be combined to the seating groove formed on the side of the vertical frame 220.

When the neighboring modular building interior and exterior material units 100 and 200 are connected to each other by using the clip 140, the gaskets 400 combined to each modular building interior and exterior material unit tightly contact each other and thereby, seal the space between the neighboring modular building interior and exterior material units 100 and 200 so that water tightness and air tightness may be increased. For example, in FIG. 8, when the clip 140 combined to the modular building interior and exterior material unit 100 is inserted into the through hole of the modular building interior and exterior material unit 200, the gasket 400 combined to the side of the modular building interior and exterior material unit 100 and the gasket 400 combined to the side of the modular building interior and exterior material unit 200 contact each other so as to block the side space between the modular building interior and exterior material unit 100 and the modular building interior and exterior material unit 200 from being exposed, as illustrated in FIG. 5 or 6. Accordingly, the same effect as in a sealant work may be obtained.

As illustrated in FIG. 4, the gasket 400 has the form of a pillar which is entirely extended in a vertical direction. The gasket 400 may be formed of an elastic material, for example, polyurethane or rubber. However, the material forming the gaskets 400 of the present invention is not restricted to polyurethane or rubber and the gaskets 400 may be formed of any other material having an elastic force, if the gaskets 400 may tightly contact each other by using an elastic force and thereby, water tightness and air tightness may be maintained.

The gasket 400 may include a coupling part 410, an elastic part 420, and a blocking part 430 as a unit.

The elastic part 420 may be formed by being extended along with the coupling part 410 and the blocking part 430 and may have the form of a pillar having a hollow therein. When the gaskets 400 are inserted into the seating grooves H1 and H2, the elastic part 420 may be protruded and combined to the side of the seating grooves H1 and H2. When the neighboring gaskets 400 tightly contact each other, the sides of the elastic parts 420 in the neighboring gaskets 400 may surface contact each other and elastic deformation may occur so that adhesion between the neighboring gaskets 400 may be increased. That is, when the elastic parts 420 surface contact each other, deformation may occur due to the hollows included therein and thereby, a space between the elastic parts 420 may be completely tight. As illustrated in the drawings, the plan sectional view of the elastic part 420 may be an oval. However, as described above, if the gaskets 400 contact each other and the sides of the elastic parts 420 surface contact each other to be completely tight, the elastic part 420 may have other cross-sectional form.

The coupling part 410 may be extended from the elastic part 420, protruded to one side direction of the elastic part 420, and inserted into the seating grooves H1 and H2 to be fixed and combined thereto. For example, the seating grooves H1 and H2 may be respectively formed on the seating frames 710 and 730, wherein the seating grooves H1 and H2 have openings narrower than the width of the inside space. In this case, the coupling parts 410 of the gaskets 400 may be inserted into the inside spaces through the openings of the seating grooves H1 and H2 by using an elastic force and then, may be fixed by being held by projection jaws 720 and 740 formed around the openings by using a restoring force. However, in the present invention, the coupling part 410 may not always have the form illustrated in the drawings. Also, the seating grooves H1 and H2 may not always have the form illustrated in the drawings. If the coupling parts 410 are inserted, combined, and fixed to the seating grooves H1 and H2 and then, are not separated therefrom, the coupling part 410 and the seating grooves H1 and H2 may have other forms.

The blocking part 430 may be extended from the front or the back of the elastic part 420, may have the form of a plate, and may be protruded to the other side direction of the elastic part 420. A direction to which the coupling part 410 is protruded and a direction to which the blocking part 430 is protruded may be opposite to each other based on the elastic part 420. Also, the blocking part 430 may be extended from the front (the lower surface of the elastic part in FIG. 7) or the back (the upper surface of the elastic part in FIG. 7) of the elastic part 420. Here, the front and the back are defined for convenience of description. If the neighboring gaskets 400 tightly contact each other, the front and the back may denote the surfaces which may hide and cover the front and the back of the elastic part 420 of the other gasket 400. For example, the blocking part 430 of the gasket inserted into the seating groove H1 is extended at the front of the elastic part 420 in FIG. 7. In this regard, when the neighboring gaskets tightly contact each other, the blocking part 430 covers an elastic part 420' of the neighboring gasket and contacts the seating frame 710 so that the outer surface of the space between the modular building interior and exterior material units 100 and 200 may be blocked and thereby, water tight and air tight effects may be obtained. Also, the blocking part 430' of the gasket inserted into the seating groove H2 is extended at the back of the elastic part 420' in FIG. 7. In this regard, when the neighboring gaskets tightly contact each other, the blocking part 430' covers an elastic part 420 of the neighboring gasket and contacts the seating frame 730 so that the inner surface of the space between the modular building interior and exterior material units 100 and 200 may be blocked and thereby, water tight and air tight effects may be obtained. That is, in the gasket combined to one vertical frame 120 from among the pair of vertical frames 110 and 120, the blocking part 430 may be extended in a direction which may block the outer surface of the space between the neighboring building interior and exterior material units. Also, in the gasket combined to the other vertical frame 110 from among the pair of vertical frames 110 and 120, the blocking part 430 may be extended in a direction which may block the inner surface of the space between the neighboring building interior and exterior material units. Accordingly, when the gaskets tightly contact and are combined to each other as in FIG. 7, water tightness and air tightness may be maximized by the first watertight and airtight by the blocking part 430, the second watertight and airtight by close contact between the elastic parts 420 and 420', and the third watertight and airtight by the blocking part 430' and may be maintained for a long period of time. In the drawing, the end of the blocking part 430 contacts the side wall of the seating frame 730 and the end of the blocking part 430' contacts the side wall of the seating frame 710. However, if the blocking parts 430 and 430' are able to block the space between the modular building interior and exterior material units, the blocking parts 430 and 430' may be combined by contacting various positions such as the other positions on the seating frames or other positions on the vertical frames.

The modular building interior and exterior material units 100 and 200 may respectively include insulators 150 and 250 combined between the pair of vertical frames 110 and 120 and the pair of vertical frames 210 and 220, wherein the insulators 150 and 250 may be spaced apart from the surface of the panels 130 and 230. That is, as the insulators 150 and 250 are spaced apart from the surface of the panels 130 and 230 in the present invention, heat insulation property may be improved. The insulators 150 and 250 may have the form of a plate or may be formed of hardened form such as urethane form. The insulators 150 and 250 may respectively include bonding plates 310 having the form of a flat plate combined on at least one side surface from among the outer side and inner side thereof. That is, the bonding plates 310 may be combined to at least one of the outer side and the inner side of the pair of vertical frames 110 and 120 and the pair of vertical frames 210 and 220. For example, the bonding plates 310 may be galvanized iron plates. The bonding plates 310 block the insulators 150 and 250 from the outside and are combined to improve heat insulation property. FIG. 6 illustrates that the insulators are combined in a space where the modular building interior and exterior material units 100 and 200 are combined to each other. As illustrated in FIG. 6, the modular building interior and exterior material units 100 and 200 are combined to each other and the insulators are combined in a space between the side surfaces of the modular building interior and exterior material units 100 and 200 so that heat insulation property may be improved. The pair of vertical frames 110 and 120 and the pair of vertical frames 210 and 220 may respectively and further include frame insulation parts 500 and 550 which surround bent portions thereof and have the form of a pipe. The frame insulation parts 500 and 550 may share one surface with the vertical frames 110, 120, 210, and 220. The frame insulation parts 500 and 550 may include inlet parts 510 and 560 and cutting parts 520 and 570. The inlet parts 510 and 560 may be opened at one side of the frame insulation parts 500 and 550 for insulation filler joints AZON 530 and 580 to be injected therethrough and the cutting parts 520 and 570 may be cut when the insulation filler joints AZON 530 and 580 are filled in the frame insulation parts 500 and 550 and then are hardened. That is, when the insulation filler joints AZON 530 and 580 are injected through the inlet parts 510 and 560 and then, the filled insulation filler joints AZON 530 and 580 are hardened, the cutting parts 520 and 570 are cut and thereby, may be also opened. In this case, the heat and cold transmitted through the vertical frames 110, 120, 210, and 220 is blocked by the inlet parts 510 and 560 and the cutting parts 520 and 570 and thereby, the heat and cold is not transmitted any longer so that heat insulation property may be improved. That is, the inlet parts 510 and 560 and the cutting parts 520 and 570 may be formed on the other surface of the frame insulation parts 500 and 550 so that the heat may not be transmitted through the vertical frames 110, 120, 210, and 220.

According to an embodiment of the present invention, when the modular building interior and exterior material units are installed, the gaskets installed at both sides tightly support each other and a threefold block is performed by the blocking parts having the form of a plate included in the gaskets in such a way that the blocking parts close the front and the back. In this regard, water does not permeate into the inside even if it rains or snows, and the inside and the outside may be completely blocked from each other so that water tightness and air tightness may be maximized. That is, when the gaskets are tightly close each other and thereby, the elastic parts tightly support each other, air tightness and water tightness may be expected. However, although the elastic parts tightly support each other, deformation may be generated due to continuous temperature changes or continuous experiences of snow, rain, and wind, as time passes and thereby, air tightness and water tightness may be lowered. Accordingly, in the modular building interior and exterior material units according to an embodiment of the present invention, when the gaskets are tightly close each other, the elastic parts tightly support each other and a threefold block is performed by the blocking parts having the form of a plate at the front and the back in such a way that the blocking parts block a space between the panels so that water tightness and air tightness may be maximized. Also, in the modular building interior and exterior material units according to an embodiment of the present invention, the gaskets are not combined to the frames by using an adhesive and instead, the coupling parts of the gaskets are inserted and fixed to the seating grooves of the frames so that water tightness and air tightness may be improved. That is, when an adhesive is used to combine the gaskets to the frames, a space may be formed or moisture or foreign materials may be entered to the adhesive portions, even if the adhesive is uniformly applied. In this regard, an adhesive strength is lowered as time passes and thereby, the adhesive portions may be parted so that problems on air tightness and water tightness may occur. On the other hand, while the coupling parts of the gaskets are inserted and fixed to the seating grooves and the elastic parts are tightly close each other in the present invention, tight contact may occur between the elastic parts and the frames and thereby, water tightness and air tightness may be improved. In addition, in the modular building interior and exterior material units according to an embodiment of the present invention, since the insulators are interposed between the vertical frames and the modular building interior and exterior material units are combined to each other without installation of the insulators to wall, the insulators may be simply installed and a closed space between the insulators and the panels may be additionally formed as the insulators and the panels are spaced apart from each other. Accordingly, insulation effect may be improved. Moreover, in the modular building interior and exterior material units according to an embodiment of the present invention, the frame insulation parts are formed on the frames so as to improve insulation effect, wherein the frame insulation parts are filled with the insulators and cut the space between the frames to prevent heat conduction.

As above, the exemplary embodiments are described with reference to the drawings and the specification. The terminologies used herein are for the purpose of describing exemplary embodiments of the present invention only and are not intended to be limiting of meanings or the scope of the present invention described in the claims. Therefore, it will be understood by those of ordinary skill in the art to which the present invention pertains that various modifications and equivalents are capable of being made to the above-described embodiments without departing from the scope the present invention as set forth in the following claims.

What is claimed is:

1. A modular building interior and exterior material unit which is combined to an adjacent modular building interior and exterior material unit to be used as an interior and exterior material in a building, the modular building interior and exterior material unit comprising:

a pair of vertical frames which are symmetric, spaced apart from each other, and comprise seating frames at a side thereof which are protruded in a longitudinal direction, wherein the seating frames comprise seating grooves formed therein;

at least one panel attached to the outside of the pair of vertical frames;

at least one clip comprising one end combined to the side of the vertical frame and the other end inserted into a through hole formed on the vertical frame of the adjacent modular building interior and exterior material unit; and gaskets which are protruded in a longitudinal direction along each side of the pair of vertical frames, combined to the seating grooves, and are formed of an elastic material, wherein when two neighboring modular building interior and exterior material units are connected to each other by the clip, the gaskets combined to the two neighboring modular building interior and exterior material units contact each other and seal a space between the two neighboring modular building interior and exterior material units, wherein each of the gaskets comprises: an elastic part which has the form of a pillar having a hollow therein; a coupling part which is extended from the elastic part, protruded to one side direction of the elastic part, and inserted into one of the seating grooves to be fixed and combined thereto; and a blocking part which is extended from the front or the back of the elastic part, has the form of a plate, and is protruded to an other side direction of the elastic part, and wherein when the gasket is combined to one vertical frame of the modular building interior and exterior material unit, the blocking part is extended in a direction which blocks an outer side of the space between the two neighboring building interior and exterior material units and when the gasket is combined to a vertical frame of the adjacent modular building interior and exterior material unit, the blocking part is extended in a direction which blocks an inner side of the space between the two neighboring building interior and exterior material units and wherein when the two neighboring modular building interior and exterior material units are connected to each other, the blocking part is extended from the elastic part so as to contact the seating frame of the neighboring modular building interior and exterior material unit.

2. The modular building interior and exterior material unit of claim 1, wherein each of the seating grooves has an opening narrower than a width of an inside space and is formed on the seating frames, and the coupling part is inserted into the inside space through the opening of the seating grooves by an elastic force and then, is fixed by being held by a projection jaw formed around the opening by a restoring force.

3. The modular building interior and exterior material unit of claim 1, wherein the gasket is formed of polyurethane or rubber.

4. The modular building interior and exterior material unit of claim 1, further comprising a bracket fixed and installed to the side of the vertical frame, wherein the bracket is combined and fixed to an anchor bolt that is fixed and installed to a wall of a building.

5. The modular building interior and exterior material unit of claim 1, further comprising an insulator combined between the pair of vertical frames, wherein the insulator is spaced apart from the at least one panel.

6. The modular building interior and exterior material unit of claim 5, further comprising at least one bonding plate having the form of a flat plate combined to at least one of the outer side and the inner side of the pair of vertical frames.

7. The modular building interior and exterior material unit of claim 1, wherein the vertical frames further comprise frame insulation parts which surround bent portions of the vertical frames and have the form of a pipe, and wherein the frame insulation parts include inlet parts which are opened at one side of the frame insulation parts for insulation filler joints to be injected therethrough; and cutting parts which are cut when the insulation filler joints are filled in the frame insulation parts through the inlet parts and then are hardened.

8. The modular building interior and exterior material unit of claim 7, wherein in the frame insulation parts, the inlet parts and the cutting parts are formed on opposite sides of the frame insulation parts so that heat and cold is not transmitted through the vertical frames.

* * * * *